United States Patent [19]

Rosenthal et al.

[11] Patent Number: 4,478,270

[45] Date of Patent: Oct. 23, 1984

[54] APPARATUS FOR CASTING LOW-DENSITY ALLOYS

[75] Inventors: Hyman Rosenthal, Fort Lee, N.J.; Harry W. Hammond, Tilton, N.H.

[73] Assignee: Interlake, Inc., Oak Brook, Ill.

[21] Appl. No.: 250,010

[22] Filed: Apr. 1, 1981

[51] Int. Cl.[3] ..... B22D 18/06

[52] U.S. Cl. ..... 164/254; 164/337; 222/602

[58] Field of Search ..... 164/253, 254, 255, 256, 164/258, 259, 284, 337; 222/602

[56] References Cited

U.S. PATENT DOCUMENTS

| | | | |
|---|---|---|---|
| 1,438,951 | 12/1922 | Elrod | 164/472 |
| 2,310,766 | 2/1943 | Dornauf | 164/284 X |
| 2,336,518 | 12/1943 | Whittaker | 222/602 |
| 3,677,332 | 7/1972 | Smiernow | 164/63 X |
| 3,724,529 | 4/1973 | Chaulet et al. | 164/256 X |
| 3,788,382 | 1/1974 | Daniel et al. | 164/255 X |
| 3,955,612 | 5/1976 | Schultheiss | 164/255 X |
| 4,254,817 | 3/1981 | Kidowaki et al. | 164/254 X |

FOREIGN PATENT DOCUMENTS

| | | | |
|---|---|---|---|
| 538477 | 6/1922 | France | 164/254 |
| 55-165266 | 12/1980 | Japan | 164/284 |
| 847862 | 9/1960 | United Kingdom | 164/254 |

OTHER PUBLICATIONS

Balevski, A. et al., "Method of Casting with Counter-pressure," Bulgarian Science and Technology Days in London, Nov. 24, 1971.

*Primary Examiner*—Nicholas P. Godici
*Assistant Examiner*—J. Reed Batten, Jr.
*Attorney, Agent, or Firm*—Emrich & Dithmar

[57] ABSTRACT

Apparatus for casting of low-density metals, such as magnesium alloys, into an air-permeable mold includes a housing forming a substantially airtight chamber in which is disposed a mold assembly including a mold secured between top and bottom plates by encircling bands or straps. A bottom-discharge reservoir vessel for molten metal is disposed above the mold, the vessel outlet communicating with the mold inlet through a coupling against which the mold assembly is resiliently urged by bias springs to insure an airtight coupling. A valve is selectively operable for opening and closing the vessel outlet and closure apparatus cooperates with the vessel for providing a substantially airtight closure thereof. A pressure control system is coupled to the vessel and the chamber for establishing a pressure differential therebetween which cooperates with gravity to urge the molten metal from the vessel into the mold when the valve is open. In one embodiment the vessel is disposed within a separate airtight chamber above the mold chamber, and in another embodiment the vessel is closed by an airtight cover plate. Clamps are provided for opening and closing the vessel and chambers to provide access to the interiors thereof.

2 Claims, 4 Drawing Figures

10
11
56
57
58
55
99
59
98
50
51
52
2.
37
23
97
54
64
65
67
20
62
53
66
21
24
98
37
36
38
36
34
22
27
28
33
13
12
24
25
29
13
26
14
14
2.

94
95
72
96
60
74
79a
78a
23
78
75
76
30
40
47
79
77
48
44
45
45
15
43

APPARATUS FOR CASTING LOW-DENSITY ALLOYS

BACKGROUND OF THE INVENTION

The present invention relates to apparatus for casting of low-density alloys and especially alloys such as magnesium-based alloys which require protection from oxidation during the pouring operation. In particular, the invention relates to apparatus for the casting of such metals into ceramic or sand molds in which the castings are thin walled and consequently difficult to cast because of problems with incomplete filling of the molds.

There has always been a problem in casting magnesium-based alloys in thin section because of the low density of the magnesium which adversely affects its fluidity. Fluidity, in a practical sense, depends upon the heat content of the molten metal, which is made up of the specific heat of the liquid and the heat of fusion which is given up during solidification. On a bulk or volumetric basis, the heat contained in magnesium at the time of pouring is relatively low. Therefore, the heat lost in the flow of the metal through the mold passages rapidly reduces the available heat to the point that solidification and flow stoppage tend to occur before the mold cavity is completely filled.

To overcome this danger of non-fill by premature solidification, the fluidity can be improved by increasing the metal velocity. The velocity is maximized by maintaining the columnar height of the liquid above the mold cavity as high as possible since the metallostatic pressure controls the velocity. But the low density of magnesium is a hindrance because the metallostatic pressure of a liquid metal is a function of the metal density.

In the lost wax molds for magnesium, the velocity can be increased by placing the plaster-binder solid mold over a vacuum port. The port tends to evacuate the air in the interstices of the mold thus allowing the ambient air pressure to accelerate the entry of the metal into the mold. Although this commonly used method is better than relying solely on gravity, it is only marginally effective. The relative ineffectiveness is due to the fact that evacuation of air from the mold cavity cannot occur until the incoming liquid metal fills the ingates and thus seals the mold cavity from the ambient atmosphere. When incoming liquid effects this seal, the evacuation of the cavity can commence. Evacuation cannot be rapid because the vacuum port must work against the resistance of the fine passageways in the refractory mold that comprise the interstices between the fine refractory particles. The velocity attained by the metal under these circumstances is limited even for small castings with small volumes to be evacuated, but, for large castings, the velocity effect is much worse and consequently the nonfill problem is even greater.

Another difficulty in pouring magnesium alloys is the constant need to prevent oxidation and burning of the liquid metal. This is commonly avoided by injecting sulfur dioxide gas into the mold and by dusting sulfur on the surface of the metal. The presence of this gas in the mold hinders fluidity because the gas must be displaced before the metal can completely fill the mold cavity.

Fluxes must also be used to prevent burning of the magnesium while it is being melted. Before pouring, the flux must be skimmed off the surface of the metal to prevent its entrapment in the casting. To reduce the danger of flux inclusions being incorporated in the stream of metal from the pouring ladle, modified ladles in teapot form are often used. This expedient reduces the flux problem but by no means eliminates it.

One casting technique which is capable of overcoming some of these problems is disclosed in a paper entitled "Method of Casting with Counterpressure", by Balevski and Dimov, dated Nov. 24, 1971, and delivered at the Bulgarian Science and Technology Days in London. The technique involves producing a "counterpressure" in the mold and then displacing the metal into the mold by the action of another greater pressure, which can be produced pneumatically, by a piston or by gravity, i.e., the metallostatic pressure of a column of metal. But the apparatus disclosed for effecting this technique is cumbersome and inefficient. The pneumatic means and piston-actuated means operate to drive the molten metal from the bottom of a vessel upwardly into an overlying mold cavity. Thus, the system has to overcome the gravitational forces on the molten metal. The gravity-operated apparatus disclosed involves a movable assembly which involves inversion of the mold and the feeding reservoir, which would be extremely costly and difficult to construct.

SUMMARY OF THE INVENTION

It is a general object of the present invention to provide an improved casting apparatus which overcomes the disadvantages of prior art apparatuses while affording additional structural and operating advantages.

It is an important object of the present invention to provide a casting apparatus which is characterized by relatively simple and inexpensive construction, while at the same time providing a controlled rate of flow of molten metal from the reservoir vessel into the mold.

In connection with the foregoing object, it is another object of this invention to provide an improved casting apparatus of the type set forth, which provides controlled flow of molten metal while utilizing gravitational forces to assist the metal flow.

Still another object of this invention is to provide a casting apparatus which utilizes both gravity and pressure differential to facilitate controlled metal flow and which provides means for insuring substantially airtight closure of the reservoir vessel and the mold.

Yet another object of this invention is to provide a casting apparatus of the type set forth which affords efficiently controlled metal flow while affording protection against combustion of the metal and flux inclusions in the mold.

These and other objects of the invention are attained by providing apparatus for casting of low-density metals into an air-permeable mold having an inlet at the top thereof, the apparatus comprising housing means forming a substantially gas-tight chamber for accommodating the associated mold therein, a reservoir vessel carried by the housing means above the associated mold for accommodating a charge of molten metal therein and having an outlet at the bottom thereof, closure means cooperating with the vessel for providing a substantially gas-tight closure thereof, coupling means providing a substantially gas-tight coupling between the vessel outlet and the mold inlet and providing communication therebetween for passage of molten metal from the vessel into the mold, pressure control means coupled to the vessel and to the chamber to vary the pressures in each for establishing in the vessel a pressure greater than the pressure in the chamber, and valve means selectively operable for opening and closing the vessel outlet, whereby upon operation of the valve means to open the vessel outlet molten metal flows from the vessel into the mold at a rate determined by gravity and the pressure differential between the vessel and the chamber.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

DESCRIPTION OF THE PREFERRED EMBODIMENTS

Figure 1:
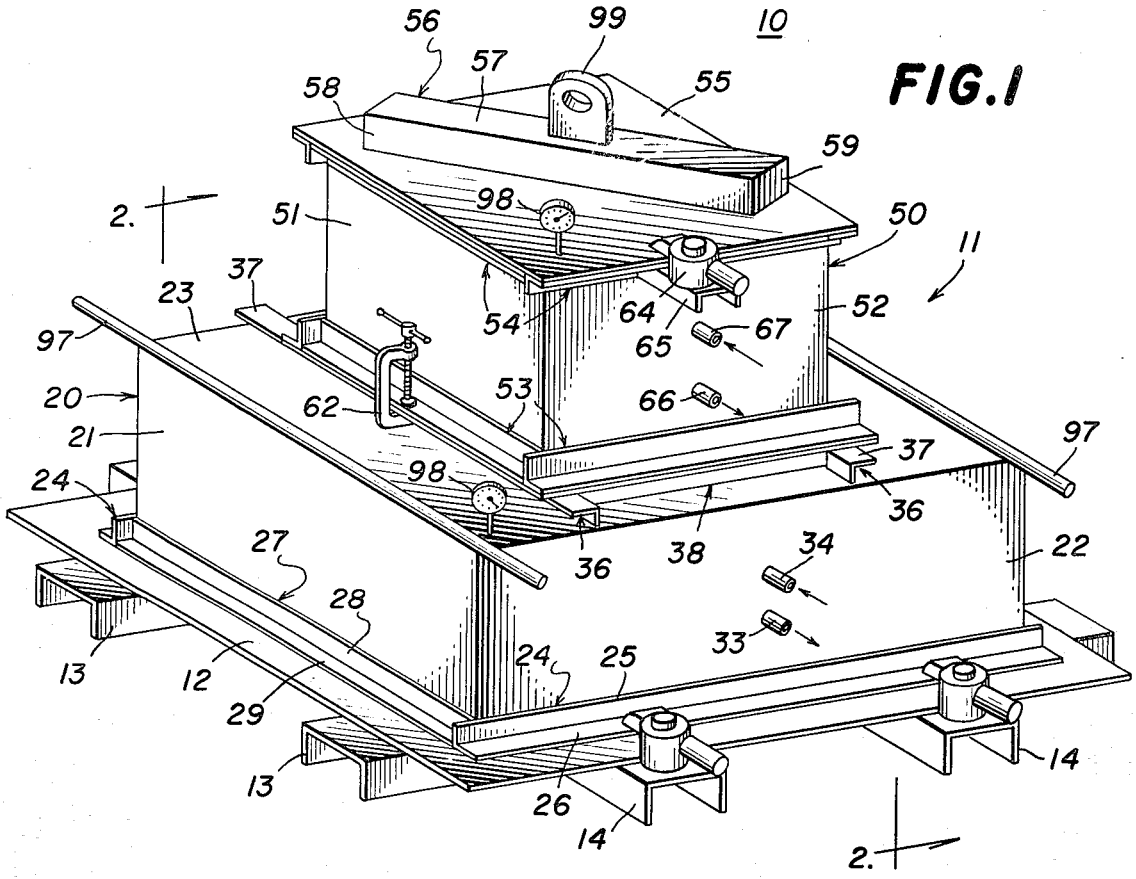
FIG. 1 is a perspective view of a casting apparatus constructed in accordance with and embodying the features of a first embodiment of the present invention with the apparatus sealed prior to pouring of the molten metal.
Figure 3:
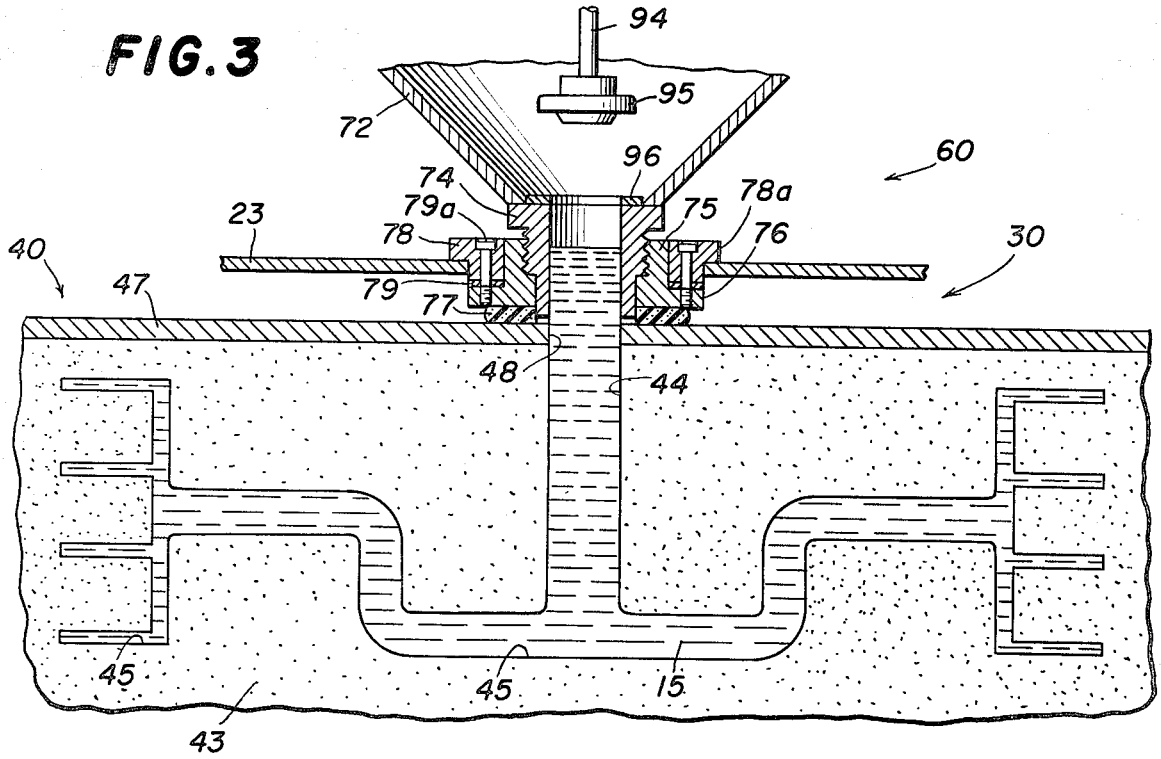
FIG. 3 is a further enlarged fragmentary sectional view of the central lower portion of the casting apparatus of FIG. 2, illustrated after pouring of the molten metal.
Figure 2:
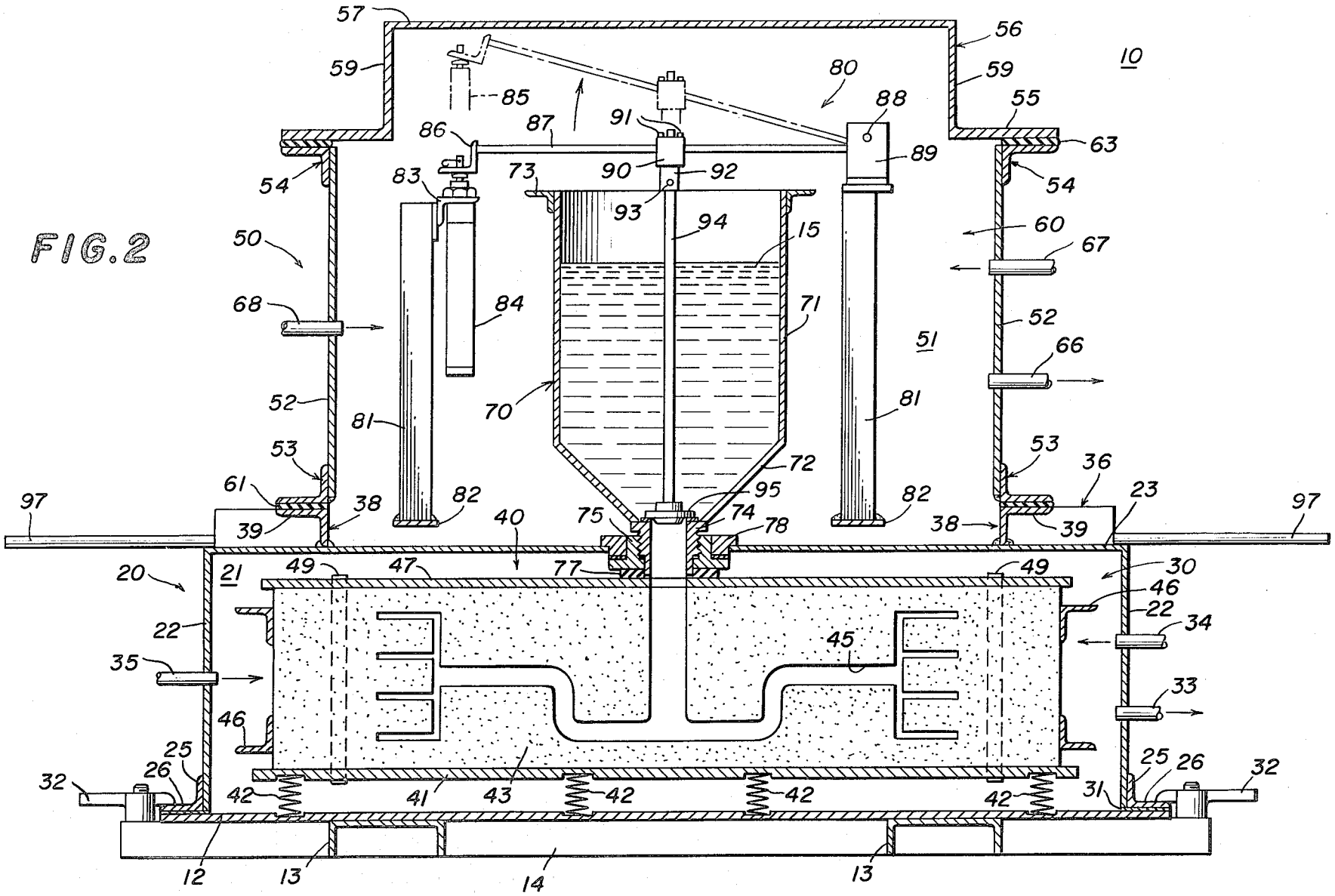
FIG. 2 is an enlarged view in vertical section taken along the line 2—2 in FIG. 1.

Referring to FIGS. 1 through 3 of the drawings, there is illustrated a casting apparatus, generally designated by the numeral 10, in accordance with a first embodiment of the present invention. The casting apparatus 10 includes a housing assembly 11 which includes a flat, rectangular base plate 12 fixedly mounted on two parallel support channels 13 and two parallel support channels 14 disposed substantially normal to the support channels 13. The casting apparatus 10 is adapted for casting a low-density molten metal 15, such as a magnesium-based alloy.

The housing assembly 11 includes a generally box-like lower housing 20 including parallel opposed side walls 21 interconnected by parallel opposed side walls 22 and closed at the top by a flat, planar top wall 23. Respectively fixedly secured to the side walls 22 along the bottom edges thereof are angle frames 24, each having a vertical flange 25 fixedly secured to the outer surface of the associated side wall 22 and a horizontal flange 26 extending laterally outwardly therefrom substantially normal thereto. In like manner, two angle frames 27 are respectively fixedly secured to the side walls 21 along the bottom edges thereof, each of the angle frames 27 having a vertical flange 28 fixedly secured to the outer surface of the associated side wall 21, and a horizontal flange 29 extending laterally outwardly therefrom substantially normal thereto. Preferably, the angle frames 24 extend beyond the ends of the associated side walls 22, the angle frames 27 being disposed between these projecting ends of the angle frames 24 and fixedly secured thereto as by welding.

The lower housing 20 is adapted to rest upon the base plate 12 for cooperation therewith to define a lower chamber 30. A gasket 31 is disposed between the base plate 12 and the horizontal flanges 26 and 29 around the entire perimeter of the lower housing 20, and clamps 32 are mounted on the support channels 14 for engagement with the horizontal flanges 26 to provide a cam-type clamping-together of the lower housing 20, the gasket 31 of the base plate 12 to provide a substantially gas-tight closure of the lower chamber 30. While swivel-type clamps 32 have been disclosed, it will be appreciated that other suitable clamping means could be used and that similar clamping means could also be mounted for engagement with the horizontal flanges 29.

Coupled to the lower housing 20 for communication with the lower chamber 30 are a vacuum conduit 33, which is connected to an associated vacuum pump (not shown), an air inlet conduit 34 connected to atmosphere through a suitable valve (not shown), and a gas inlet conduit 35, connected to an associated source (not shown) of suitable protective gas, such as sulfur dioxide.

Fixedly secured to the top wall 23 of the lower housing 20 are two spaced-apart angle irons 36, respectively parallel to the angle frames 27, and each arranged with the distal edge of the vertical flange thereof fixedly secured, as by welding, to the top surface of the top wall 23, and with the horizontal flange 37 thereof extending laterally outwardly therefrom substantially parallel to the top wall 23. Extending between and interconnecting the angle irons 36 substantially perpendicular thereto are two spaced-apart angle irons 38, each arranged with the distal edge of the vertical flange thereof fixedly secured, as by welding, to the top surface of the top wall 23, and with the horizontal flange 39 thereof extending laterally outwardly therefrom generally parallel to the top wall 23.

Disposed within the lower chamber 30 is a mold assembly, generally designated by the numeral 40, which includes a flat, rectangular support plate 41 supported above the base plate 12 by a plurality of helical compression springs 42. Mounted on the support plate 41 is a mold 43, which is formed of a gaspermeable material such as sand or ceramic. The mold 43 has an inlet port 44 at the top thereof communicating with the channels of a mold cavity 45. Preferably, the mold 43 is surrounded by horizontal retaining members 46 which may be angle irons, and is provided with a flat, rectangular chill plate 47 disposed on top of the mold 43 and having an opening 48 therein in registry with the inlet port 44 of the mold 43, the entire assembly being secured together by bands 49.

The housing assembly 11 also includes an upper housing, generally designated by the numeral 50, which is substantially box-like in shape and includes a pair of opposed side walls 51 interconnected by a pair of opposed side walls 52. Respectively fixedly secured to the side walls 51 and 52 along the lower edges thereof are found angle frames 53, each having the vertical flange thereof secured, as by welding, to the outer surface of the associated side wall 51 or 52, and having the horizontal flange thereof extending laterally outwardly substantially normal to the associated side wall 51 or 52. In like manner, each of the side walls 51 and 52 has secured thereto at the upper end thereof an angle frame 54, having the horizontal flange thereof extending laterally outwardly of the upper housing 50. In use, the horizontal flanges of the angle frames 53 are respectively adapted to rest upon the horizontal flanges 37 and 39 of the angle irons 36 and 38.

The upper housing 50 also includes a top plate 55 having an upwardly extending rectangular extension portion 56 including a flat top wall 57, opposed rectangular side walls 58 and opposed rectangular end walls 59. In use, the top plate 55 is adapted to be supported upon the horizontal flanges of the angle frames 54 for cooperation therewith and with the angle irons 36 and 38 and the top wall 23 of the lower housing 20 to form a closed upper chamber 60. More specifically, a gasket 61 is disposed between the horizontal flanges of the angle frames 53 and the angle irons 36 and 38 and are clamped together therewith by suitable clamping means such as C-clamps 62, while a gasket 63 is disposed between the horizontal flanges of the angle frames 54 and the top plate 55 around the entire perimeter thereof, and is clamped together therewith by suitable clamps 64 to form a substantially gastight closure of the upper chamber 60. The clamps 64 are disclosed as being supported on support brackets 65 extending laterally outwardly of the side walls 52 (see FIG. 1). It will be appreciated that other types of clamping means could be used and that clamps could be provided on all sides of the upper housing 50, if desired.

Coupled to the side walls 52 of the upper housing 50 for communication with the upper chamber 60 are a vacuum conduit 66 connected to an associated vacuum pump (not shown), an air inlet conduit 67 connected to atmosphere through a suitable valve (not shown), and a gas inlet conduit 68, connected to an associated source (not shown) of protective gas, such as sulfur dioxide.

Disposed within the upper chamber 60 is a reservoir vessel, generally designated by the numeral 70, which includes an open-top circular cylindrical side wall 71 connected at the lower end thereof to a frustoconical bottom wall 72. Fixedly secured to the outer surface of the side wall 71 at the upper end thereof and extending radially outwardly therefrom is an annular flange 73. Fixedly secured to the frustoconical wall 72 at the lower end thereof coaxially therewith is a cylindrical outlet nozzle 74 having an externally threaded portion thereon, and which is adapted to extend through an opening in the top wall 23 of the lower housing 20. Threadedly engaged with the outlet nozzle 74 is an annular inner collar 75 having at the lower end thereof a radially outwardly extending annular flange 76. The outlet nozzle 74 is dimensioned to be disposed substantially in registry with the opening 48 in the chill plate 47 and the inlet port 44 of the mold 43. Disposed in surrounding relationship with the distal end of the outlet nozzle 74, between the chill plate 47 and the annular flange 76 of the collar 75 is a gasket-type seal 77. Disposed in surrounding relationship with the inner collar 75 is an outer collar 78 provided at the upper end thereof with a radially outwardly extending flange 78*a* which overlies the top wall 23 of the lower housing 20 and is secured thereto as by welding, a seal gasket 79 being disposed between the outer collar 78 and the flange 76 of the inner collar 75 and being secured together therewith by bolts 79*a*.

It will be appreciated that the outlet nozzle 74, the collars 75 and 78 and the gaskets 77 and 79 cooperate with the chill plate 47 to form a coupling means between the reservoir vessel 70 and the mold 43, this coupling means filling and sealing the opening in the top wall 23 of the lower housing 20 and cooperating therewith to maintain substantially gastight separation between the lower chamber 30 and the upper chamber 60.

Also mounted within the upper chamber 60 is a discharge assembly, generally designated by the numeral 80, which includes a pair of upstanding posts 81 respectively disposed on opposite sides of the reservoir vessel 70 and adjacent to opposite corners of the upper chamber 60. Each of the posts 81 may be in the form of an angle iron secured at the lower end thereof to a suitable support member 82 carried by the lower housing 20. Fixedly secured to one of the posts 81 at the upper end thereof is a mounting bracket 83 for mounting thereon a pneumatic cylinder 84, the piston rod 85 of which extends vertically upwardly and is coupled by means of a coupling bracket 86 to one end of a lever arm 87 which extends diagonally across the upper chamber 60. The other end of the lever arm 87 is pivotally connected, as by a pivot pin 88, to a pivot bracket 89 carried at the upper end of the other post 81.

Connected to the lever arm 87 intermediate the ends thereof is a coupling member 90, fixedly secured in place by means of setscrews 91. Depending from the coupling member 90 is a clevis 92 supporting a pivot pin 93 on which is pivotally mounted one end of a connecting rod 94 which extends vertically downwardly through the reservoir vessel 70, substantially coaxially therewith. Secured to the connecting rod 94 at the lower end thereof is a valve member or stopper 95 dimensioned for engagement with an annular gasket 96 seated on the upper end of the outlet nozzle 74 for closing the outlet of the reservoir vessel 70.

In use, when the discharge assembly 80 is disposed in the position illustrated in solid line in FIG. 2, the outlet of the reservoir vessel 70 is closed. For opening this outlet, the cylinder 84 is actuated to extend the piston rod 85 thereof upwardly to the position illustrated in broken line in FIG. 2, thereby lifting the stopper 95 and permiting molten metal 15 to flow from the reservoir vessel 70 through the outlet nozzle 74. Suitable pneumatic controls (not shown) for the cylinder 84 may be provided so that it can be operated from outside the casting apparatus 10. It can be seen that the movement of the discharge assembly 80 between its open and closed positions is accommodated by the extension portion 56 of the upper housing 50.

If desired, elongated handle rods 97 may be fixedly secured, as by welding, to the outer surface of the lower housing 20 to facilitate handling and lifting of the casting apparatus 10 and the lower housing 20 thereof. Suitable pressure gauges 98 may be coupled to each of the upper and lower housings 50 and 20 to permit monitoring of the pressure within the upper and lower chambers 60 and 30 from outside the casting apparatus 10. A coupling eye 99 may be fixedly secured to the extension portion 56 of the top plate 55 to facilitate lifting thereof from the upper housing 50, and to facilitate lifting of the upper housing 50 from the lower housing 20.

In operation, the mold assembly 40 is first assembled and then mounted on the springs 42 upon the base plate 12. The reservoir vessel 70 is then assembled to the lower housing 20. In this regard, the inner collar 75 may first be bolted to the outer collar 78. The discharge nozzle 74 is then threadedly engaged in the inner collar 75, and the gasket 77 is mounted in place around the distal end of the discharge nozzle 74 which projects a predetermined distance below the lower end of the inner collar 75. The discharge assembly 80 is then moved to its closed condition. In this regard, it will be noted that the coupling bracket 86 is detachable from the piston rod 85, as by means of a cotter pin, so that the lever arm 87 can be moved out of the way to permit mounting of the reservoir vessel 70.

Next, the lower housing 20, with the reservoir vessel 70 and discharge assembly 80 thereon, is lowered into place over the mold assembly 40 and clamped to the base plate 12 by the clamps 32. Next, molten metal is charged into the reservoir vessel 70 and then the upper housing 50 is lowered into place on the lower housing 20. In this regard, the top plate 55 may first be assembled to the side walls 51 and 52 and then lowered as a unit onto the angle irons 36 and 38 and clamped thereto by the C-clamp 62. Alternatively, the side walls 51 and 52 may be assembled to the lower housing 20 first and, later, after charging of molten metal into the reservoir vessel 70, the top plate 55 may be mounted in place and clamped by the clamps 64.

As soon as the lower housing 20 has been mounted in place over the mold assembly 40, the lower chamber 30 may be evacuated through the vacuum conduit 33 and the protective gas such as sulfur dioxide may be introduced through the gas inlet conduit 35 in an amount sufficient to provide the desired pressure in the lower chamber 30. When the upper housing 50 is mounted in place, the upper chamber 60 may be evacuated through the vacuum conduit 66 and protective gas may be introduced through the gas inlet conduit 68 until the pressure within the upper chamber 60 has reached a predetermined desired pressure greater than that in the lower chamber 30. It will also be understood that the concentration, of the protective gas in the upper and lower chambers 60 and 30 may be effectively controlled by varying the degree of evacuation of air from these chambers.

The discharge assembly 80 is then operated to lift the stopper 95 and open the outlet of the reservoir vessel 70 to permit molten metal 15 to flow through the discharge nozzle 74 and the mold inlet port 44 into the mold cavity 45, the rate of this flow being a function of the metallostatic pressure of the molten metal and the gas pressure differential between the upper and lower chambers 60 and 30. As the molten metal 15 enters the mold cavity 45 it displaces the protective gas therefrom, in a well-known manner. Preferably, sufficient metal is provided in the reservoir vessel 70 so that when the mold cavity 45 is filled, cessation of metal flow results in the final level of the cast metal being at the position illustrated in FIG. 3, well within the discharge nozzle 74, so that the cast metal helps to preserve the seal between the upper and lower chambers 60 and 30.

When solidification of the metal is complete, atmospheric pressure is restored to the lower chamber 30 via the conduit 34 and to the upper chamber 60 via the conduit 67. Disassembly of the apparatus 10 can then proceed to remove the poured mold. The apparatus 10 is then ready for a new casting cycle.

It is a significant feature of the present invention that the disposition of the reservoir vessel 70 above the mold 43, together with the use of the stopper 95 of the discharge assembly 80, permits gravitational force to be utilized to drive the molten metal 15 into the mold 43, while at the same time permitting the accurate control of the flow rate by the use of the pressure differential between the upper and lower chambers 60 and 30. This accurate control of the metal velocity insures complete filling of the mold 43. Furthermore, it will be appreciated that the pressure differential between the two chambers 60 and 30 assists in obtaining a sound casting by pressurizing the liquid in the gating system of the mold 43, thereby avoiding porosity in the casting. The discharging of liquid metal from the bottom of the reservoir vessel 70 avoids any problems of flux inclusion and the pressurized chambers 60 and 30 permit convenient maintenance of a protective atmosphere to prevent oxidation of the metal.

It is another significant feature of the invention that the biasing force applied by the springs 42 serves resiliently to urge the mold assembly 40 against the seal gasket 77 to insure a gas-tight coupling between the mold assembly 40 and the reservoir vessel 70, while maintaining gas-tight separation between the upper and lower chambers 60 and 30.

Figure 4:
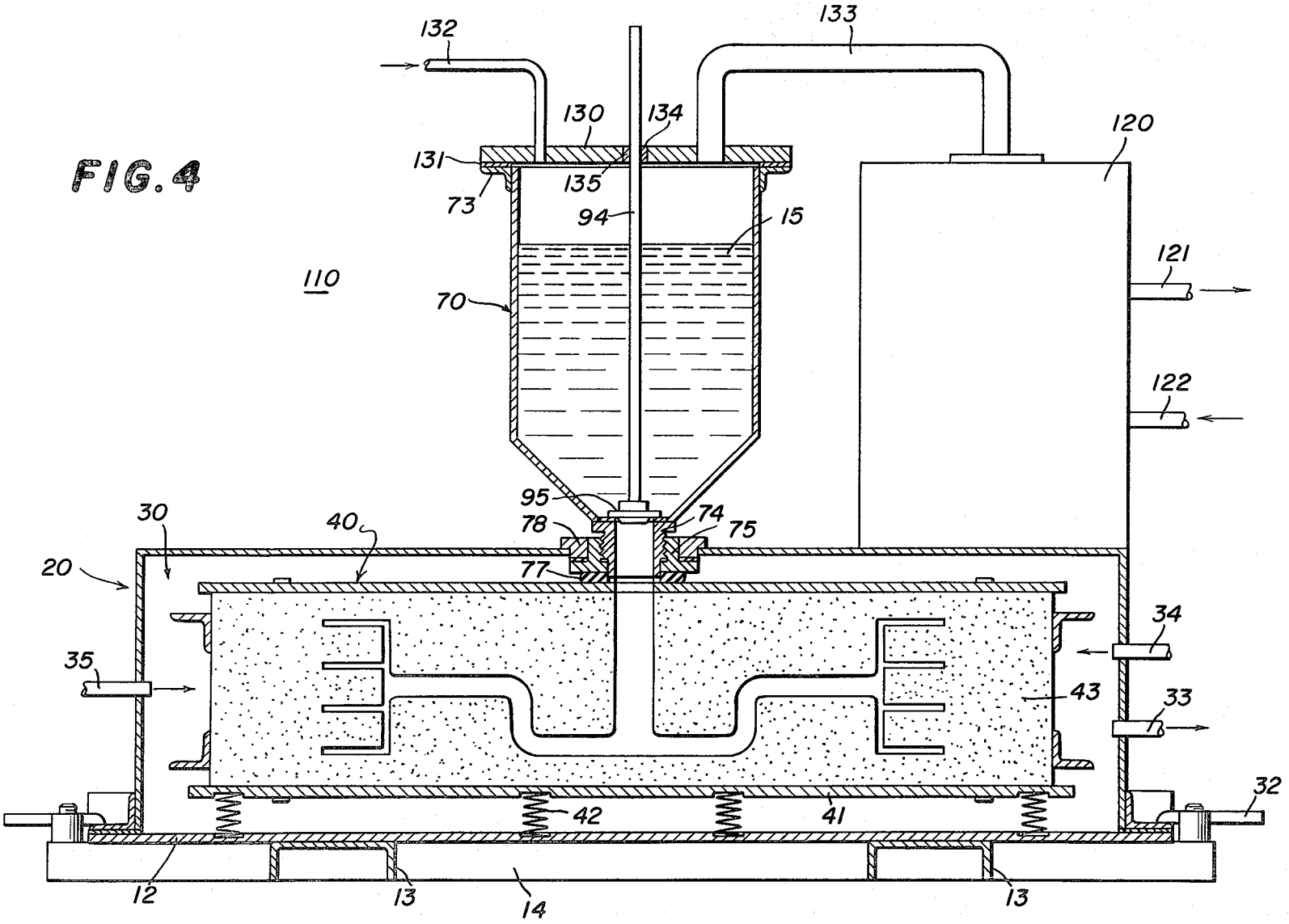
FIG. 4 is a view, similar to FIG. 2, of a casting apparatus constructed in accordance with and embodying the features of a second embodiment of the present invention.

Referring now to FIG. 4 of the drawings, there is illustrated an alternative embodiment of the casting apparatus of the present invention, generally designated by the numeral 110. The casting apparatus 110 includes a base plate 12 and lower housing 20 which cooperate to define a lower chamber 30 in which is disposed a mold assembly 40, all exactly as explained above in connection with the casting apparatus 10. Similarly, the casting apparatus 110 includes a reservoir vessel 70 which is mounted on and coupled to the lower housing 20 by means of a discharge nozzle 74, inner and outer collars 75 and 78 and gasket 77, the outlet of the reservoir vessel 70 being controlled by a stopper valve 95 connected by a connecting rod 94 to a suitable discharge apparatus 80, all as described above in connection with the casting apparatus 10.

Also mounted on the lower housing 20 is a tank 120 which is coupled by a vacuum conduit 121 to an associated vacuum pump (not shown) and is connected through an air inlet conduit 122 to atmosphere through a suitable valve (not shown). A top plate 130 is provided for closing the top of the reservoir vessel 70, the top plate 130 being dimensioned for resting upon the annular flange 73 of the reservoir vessel 70 and being spaced therefrom by a suitable gasket 131 and clamped together therewith by suitable clamps (not shown) which may be of the same type illustrated in FIGS. 1 through 3.

Coupled to the top plate 130 and communicating with the interior of the reservoir vessel 70 is a gas inlet conduit 132 which is connected to an associated source (not shown) of protective gas, such as sulfur dioxide. An air conduit 133 is provided having one end thereof coupled to the tank 120 and the other end thereof coupled to the top plate 130 for providing communication between the tank 120 and the reservoir vessel 70. A circular aperture 134 is formed in the top plate 130 centrally thereof and receives therein a seal ring or bushing 135 disposed in sliding sealing engagement with the connecting rod 94 to accommodate vertical movement thereof while maintaining a substantially airtight closure of the reservoir vessel 70.

In use, the casting apparatus 110 operates in substantially the same manner as was described above with respect to the casting apparatus 10. More specifically, the mounting of the mold assembly 40, the connection of the reservoir vessel 70 to the lower housing 20 and the mounting of the lower housing 20 on the base plate 12 is all substantially as described above in connection with the casting apparatus 10. The desired gas concentration and pressure is then established in the lower chamber 30 and the desired amount of molten metal is charged into the reservoir vessel 70. The top plate 130 is then secured in place, and the air is evacuated from the reservoir vessel 70 through the conduit 133, tank 120 and vacuum conduit 121, protective gas in the desired amount being introduced through the gas inlet conduit 132. The stopper 95 is then lifted to permit entry of the molten metal 15 into the mold assembly 40 in exactly the same manner as was described above in connection with the casting apparatus 10. After the casting cycle is complete, atmospheric pressure may be restored to the reservoir vessel 70 through the air inlet conduit 122, the tank 120 and the conduit 133. Preferably, the volume of the tank 120 should be several times that of the liquid metal so as to avoid excessive pressure drop resulting from the falling metal level in the reservoir vessel 70 when casting takes place.

Fluidity of the molten metal is facilitated by keeping the pressure in the lower chamber 30 as low as possible, in order to reduce the time required for the incoming metal to displace the resident gas. A convenient range is from about 10 millimeters to about 100 millimeters of mercury, which range is easily attainable by commercially available vacuum pumps. With a given pressure established in the lower chamber 30, the higher pressure assigned to the upper chamber 60 or reservoir vessel 70 then determines the pressure differential. This differential governs the metal velocity during pour and can be varied over a wide range to levels even above one atmosphere.

However, it is known to those skilled in the art of metal founding that excessive velocity can lead to detrimental effects such as mold erosion, mold breakage, and damage to the metal quality by turbulence of the metal stream. The velocity that is optimum for a given casting can be entirely unsuitable for another casting. It is an attribute of this invention that the pressure differential, and hence the velocity, can be so widely varied as to suit the needs of a very wide spectrum of casting geometries. It has been found that in the casting of magnesium-based alloys, desirable pressures are approximately 50 millimeters of mercury in the lower chamber 30 and approximately 250 millimeters of mercury in the upper chamber 60 or reservoir vessel 70, resulting in a pressure differential of about 200 millimeters of mercury.

By confining the pouring operation to a sealed unit, the present invention greatly reduces the oxidation and burning problem normally encountered with molten magnesium. Furthermore, the sulfur dioxide or other protective gases used to control oxidation and burning cannot be dispersed and lost as in air pouring.

Another important benefit of this invention is the virtual elimination of the flux inclusion problem. The fluxes which are responsible for this problem are light in density and float on the surface of the liquid metal. Thus, flux contamination is substantially eliminated by pouring from the bottom of the reservoir vessel 70.

In constructional models of the casting apparatus 10 and 110, the parts are preferably formed of steel and interconnected by welding, except where otherwise indicated. While the present invention is particularly advantageous in the casting of magnesium alloys, it will be appreciated that it can also be used for the casting of other types of liquid metals.

What is claimed is:

1. Apparatus for casting of metals into a gas-permeable mold having an inlet, said apparatus comprising a resevoir vessel for accommodating therein a charge of molten metal and having an outlet, closure means cooperating with said vessel for providing a substantially gas-tight closure thereof, housing means forming a substantially gas-tight chamber for accommodating the associated mold therein and having an inlet opening, coupling means providing communication between said vessel outlet and the mold inlet for passage of molten metal from said vessel into the mold through said inlet opening in said housing means, said coupling means including an outlet nozzle fixedly secured to said resevoir vessel and extending through said inlet opening in said housing means, first collar means disposed in surrounding relationship with said outlet nozzle and coupled thereto, second collar means fixedly secured to said housing means in gas-tight relationship therewith around the entire perimeter of said inlet opening, attachment means fixedly securing said first and second collars together and providing a gas-tight seal therebetween, and a gasket disposed between said first collar means and the mold in surrounding relationship with said outlet nozzle within said chamber for effecting a substantially gas-tight seal between said first collar means and said mold, mounting means disposed in said chamber and cooperating with said housing means resiliently to urge the mold against said gasket for compression thereof to insure formation of a substantially gas-tight coupling between said vessel and the mold inlet, and pressure control means coupled to said vessel and to said chamber to vary the pressures in each for establishing in said vessel a pressure greater than the pressure in said chamber for urging the molten metal through said coupling means and into the mold inlet.

2. The apparatus of claim 1, and further including valve means selectively operable between valve-opening and valve-closing positions for opening and closing said vessel outlet, a connecting member connected to said valve means and extending upwardly through said vessel, an elongated lever member extending across the top of said vessel and pivotally mounted adjacent to one side thereof, means pivotally connecting said connecting member to said lever member, means for adjusting the position along said lever member at which said connecting member is attached thereto, and power means coupled to said lever means for effecting movement thereof between the valve-opening and the valve-closing positions thereof.

* * * * *